US007963292B2

(12) United States Patent
Kennichi et al.

(10) Patent No.: US 7,963,292 B2
(45) Date of Patent: Jun. 21, 2011

(54) DISH WASHING MACHINE PREVENTING EXCESSIVE WATER PRESSURE

(75) Inventors: Shimotera Kennichi, Seoul (KR); Jung Chan Ryu, Suwon-si (KR); Young Ho Kwon, Seongman-si (KR); Sung Jin Kim, Suweon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 412 days.

(21) Appl. No.: 12/076,124

(22) Filed: Mar. 13, 2008

(65) Prior Publication Data

US 2008/0223420 A1 Sep. 18, 2008

(30) Foreign Application Priority Data

Mar. 15, 2007 (KR) ..... 10-2007-0025633

(51) Int. Cl.
*B08B 11/00* (2006.01)

(52) U.S. Cl. ..... 134/104.4

(58) Field of Classification Search ..... 134/104.4
See application file for complete search history.

(56) References Cited

U.S. PATENT DOCUMENTS

| | | | | |
|---|---|---|---|---|
| 3,586,011 | A * | 6/1971 | Mazza | 134/57 D |
| 6,832,617 | B2 * | 12/2004 | Hegeman et al. | 134/111 |
| 2004/0163680 | A1 * | 8/2004 | Elick et al. | 134/25.2 |
| 2006/0060225 | A1 * | 3/2006 | Han et al. | 134/56 D |

FOREIGN PATENT DOCUMENTS

| | | |
|---|---|---|
| CN | 2525934 | 12/2002 |
| CN | 1428124 | 7/2003 |
| KR | 10-2006-0024597 | 3/2006 |

OTHER PUBLICATIONS

Chinese Office Action for corresponding Chinese Application 200810083599.4

* cited by examiner

*Primary Examiner* — Michael Cleveland
*Assistant Examiner* — Samuel A Waldbaum
(74) *Attorney, Agent, or Firm* — Staas & Halsey LLP

(57) ABSTRACT

Disclosed herein is a dish washing machine that is capable of preventing the unintentional drainage of some wash water by the increase of the water pressure in a sump due to the excessive accumulation of filth in the sump. The dish washing machine includes a washing tub, at least one injection nozzle disposed in the washing tub, a sump disposed in the washing tub to forward wash water to the at least one injection nozzle, a guide pipe connected between the sump and the at least one injection nozzle, and a bypass pipe, diverging from a portion of the guide pipe, connected to the sump to bypass the wash water in the sump to the guide pipe.

11 Claims, 8 Drawing Sheets

DISH WASHING MACHINE PREVENTING EXCESSIVE WATER PRESSURE

CROSS-REFERENCE TO RELATED APPLICATIONS

This application claims the benefit of Korean Patent Application No. 2007-25633, filed on Mar. 15, 2007 in the Korean Intellectual Property Office, the disclosure of which is incorporated herein by reference.

BACKGROUND

1. Field

The present invention relates to a dish washing machine, and more particularly, to a dish washing machine that is capable of preventing the excessive increase of wash water pressure in a sump due to an accumulation of foreign matter in the sump.

2. Description of the Related Art

A dish washing machine is a machine that automatically washes dishes using cold water or hot water. A conventional dish washing machine includes a machine body, a washing tub formed in the machine body, dish baskets mounted in the washing tub, and injection nozzles mounted at an upper part, a middle part, and a lower part of the washing tub to inject wash water, which is disclosed in Korean Patent Application Publication No. 2006-24597.

At a bottom of the washing tub is mounted a sump to receive wash water and pump the wash water to the respective nozzles. The sump includes a sump housing forming an external appearance of the sump, a lower casing coupled to a top of the sump housing and having a filth chamber, and an upper casing coupled to a top of the lower casing and having a flow channel to guide the wash water to the upper and lower parts of the washing tub.

The injection nozzles are connected with the sump via a guide pipe.

The dish washing machine with the above-stated construction is operated as follows. After wash water is supplied into the washing tub, the wash water is introduced into the sump. By a pumping operation of the sump, the wash water flows to the injection nozzles through the guidance of a flow channel defined in the sump and a guide pipe connected with the flow channel, and is then injected to dishes at high pressure to wash food waste off the dishes. The wash water mixed with the food waste is reintroduced into the sump, and the above process is repeatedly carried out.

The filth chamber serves to collect the food waste mixed with the wash water. The filth chamber is connected to the flow channel. In an upper part of the filth chamber is mounted a mesh filter to separate the food waste from the wash water.

Specifically, when wash water and filth, including food waste, are introduced into the filth chamber, the wash water is reintroduced into the sump through the mesh filter mounted in the upper part of the filth chamber. However, the filth introduced into the filth chamber does not pass through the mesh filter but is left in the filth chamber. As the wash water repeatedly circulates, the filth continuously accumulates in the filth chamber.

When a drainage pump connected to the filth chamber is operated, the filth is discharged out of the dish washing machine.

However, when the mesh filter is clogged due to a rapid accumulation of the filth in the filth chamber, the wash water introduced into the filth chamber cannot flow out through the mesh filter. As a result, the water pressure in the filth chamber abruptly increases.

Consequently, the wash water is drained out of the dish washing machine due to the high water pressure although the drainage pump is not operated.

SUMMARY

Therefore, it is an aspect of the embodiment to provide a dish washing machine that is capable of preventing an abrupt increase of water pressure in a filth chamber and smoothly accomplishing the circulation of wash water, whereby the malfunction of the dish washing machine is effectively prevented.

Additional aspects and/or advantages will be set forth in part in the description which follows and, in part, will be apparent from the description, or may be learned by practice of the invention.

The foregoing and/or other aspects are achieved by providing a dish washing machine, including a washing tub, at least one injection nozzle disposed in the washing tub, a sump disposed in the washing tub to forward wash water to the at least on injection nozzle, a guide pipe connected between the sump and the at least one injection nozzle, and a bypass pipe, diverging from a portion of the guide pipe, connected to the sump to bypass the wash water in the sump to the guide pipe.

When the pressure of the wash water introduced into the bypass pipe exceeds a predetermined pressure level, the bypass pipe may be opened to bypass the introduced wash water to the guide pipe.

The dish washing machine may further include a check valve disposed in the bypass pipe to open and close the bypass pipe based on the pressure of the wash water introduced into the bypass pipe.

The dish washing machine may further include a filth chamber disposed in the sump to collect filth contained in the wash water. The bypass pipe communicates with the filth chamber.

The dish washing machine may further include a mesh filter disposed on the filth chamber to separate the filth from the wash water introduced into the filth chamber. The bypass pipe is coupled to one side of the mesh filter.

the at least one injection nozzle may include a main nozzle to continuously inject wash water during the washing operation of the dish washing machine and a sub nozzle to selectively inject wash water during the washing operation of the dish washing machine. The dish washing machine may further include a main channel disposed in the sump such that the main channel communicates with the main nozzle, a sub channel disposed in the sump such that the sub channel communicates with the sub nozzle, and a sampling channel disposed in the sump and allowing the main channel and the filth chamber to communicate with each other therethrough. The bypass pipe may be located above the sampling channel such that the bypass pipe communicates with the sampling channel.

The dish washing machine may further include a drainage pump disposed at the sump to drain the wash water and filth in the sump out of the dish washing machine, and a drainage guide pipe to allow the drainage pump and the filth chamber to communicate with each other therethrough. An end of the bypass pipe may be disposed at one side of the drainage guide pipe such that the end of the bypass pipe is closer to the main channel than to the drainage guide pipe.

The sump may include a sump housing forming a lower part of the sump, an impeller casing disposed on the sump casing to receive a washing impeller to pump wash water, the impeller casing being provided with a main channel and a sub channel to guide the flow of the wash water pumped by the washing impeller, a filth chamber communicating with the main channel to collect filth contained in the wash water, and a sampling channel to allow the filth chamber and the main channel to communicate with each other therethrough, and an impeller casing cover to cover the impeller casing. An end of the bypass pipe may be coupled to the impeller casing cover while the end of the bypass pipe is located at an upper part of an outlet of the sampling channel.

The guide pipe may be provided at a lower end thereof with the bypass pipe and an introduction guide pipe arranged in parallel with the bypass pipe, the introduction guide pipe being spaced apart from the bypass pipe and communicating with the main channel to guide wash water to the guide pipe, whereby wash water passing through the bypass pipe is mixed with the wash water passing through the introduction guide pipe, and the mixture is moved to the injection nozzle.

The foregoing and/or other aspects are achieved by providing a dish washing machine including a washing tub, at least one injection nozzle rotatably disposed in the washing tub to inject wash water, a sump to pump wash water to the at least one injection nozzle, a guide pipe connected between the sump and the at least one injection nozzle to guide the wash water to the at least one injection nozzle, an introduction guide pipe disposed at an end of the guide pipe and coupled to the sump to transfer the wash water from the sump to the guide pipe, and a bypass pipe connected to the end of the guide pipe and coupled to the sump to bypass wash water to the guide pipe when pressure of the wash water in the sump exceeds a predetermined pressure level.

The dish washing machine may further include a check valve disposed in the bypass pipe such that the check valve is opened and closed based on the pressure of the wash water.

The dish washing machine may further include a main channel disposed in the sump such that the main channel communicates with the introduction guide pipe to guide the pump wash water to the introduction guide pipe, a filth chamber disposed in the sump communicating with the main channel to collect filth contained in the wash water, and a sampling channel disposed in the sump and allowing the main channel and the filth chamber to communicate with each other therethrough. The bypass pipe is located above the sampling channel, and the filth chamber communicates with the sampling channel.

The dish washing machine may further include a drainage guide pipe disposed at the sump such that the drainage guide pipe communicates with the filth chamber to guide the drainage of the wash water and filth. An end of the bypass pipe is disposed closer to an outlet of the sampling channel than to an inlet of the drainage guide pipe.

The foregoing and/or aspects are achieved by providing a dish washing machine, including: a washing tub; a sump disposed in the washing tub and including a main channel, a filth chamber and a sampling channel connecting the main channel and the filth chamber; and a guide pipe including an introduction guide pipe and a bypass pipe coupled to the sump, an end of the introduction guide pipe being disposed in the main channel, and an end of the bypass pipe being disposed in the sampling channel.

Wash water from the filth chamber may be introduced into the introduction guide pipe from the main channel when water pressure in the filth chamber does not exceed a predetermined pressure level, and the wash water may be introduced into the introduction guide pipe from the main channel and into the bypass pipe from the sampling channel when the water pressure in the filth chamber exceeds the predetermined pressure level.

The introduction guide pipe and the bypass pipe may be arranged in parallel with one another.

The bypass pipe may include a check value, the check valve being opened when the water pressure in the filth chamber exceeds the predetermined pressure level thus causing the wash water to be introduced into and forced up through the bypass pipe.

The dish washing machine may further includes at least one nozzle in communication with the guide pipe, wherein the wash water introduced into the introduction guide pipe and the wash water introduced into the bypass pipe when the water pressure in the filth chamber exceeds the predetermined pressure level are mixed together before flowing to the at least one nozzle.

The foregoing and/or other aspects are achieved by providing a sump of a dish washing machine, including: a main channel; a filth chamber receiving wash water and filth and communicating with the main channel; a sampling channel connecting the main channel and the filth chamber; and a guide pipe including an introduction guide pipe and a bypass pipe coupled to the sump, an end of the introduction guide pipe being disposed in the main channel, and an end of the bypass pipe being disposed in the sampling channel, the wash water from the filth chamber being introduced into the introduction guide pipe from the main channel when water pressure in the filth chamber does not exceed a predetermined pressure level, and the wash water being introduced into the introduction guide pipe from the main channel and into the bypass pipe from the sampling channel when the water pressure in the filth chamber exceeds the predetermined pressure level.

BRIEF DESCRIPTION OF THE DRAWINGS

These and/or other aspects and advantages will become apparent and more readily appreciated from the following description of the embodiment, taken in conjunction with the accompanying drawings, of which.

DETAILED DESCRIPTION OF THE EMBODIMENT

Figure 1:
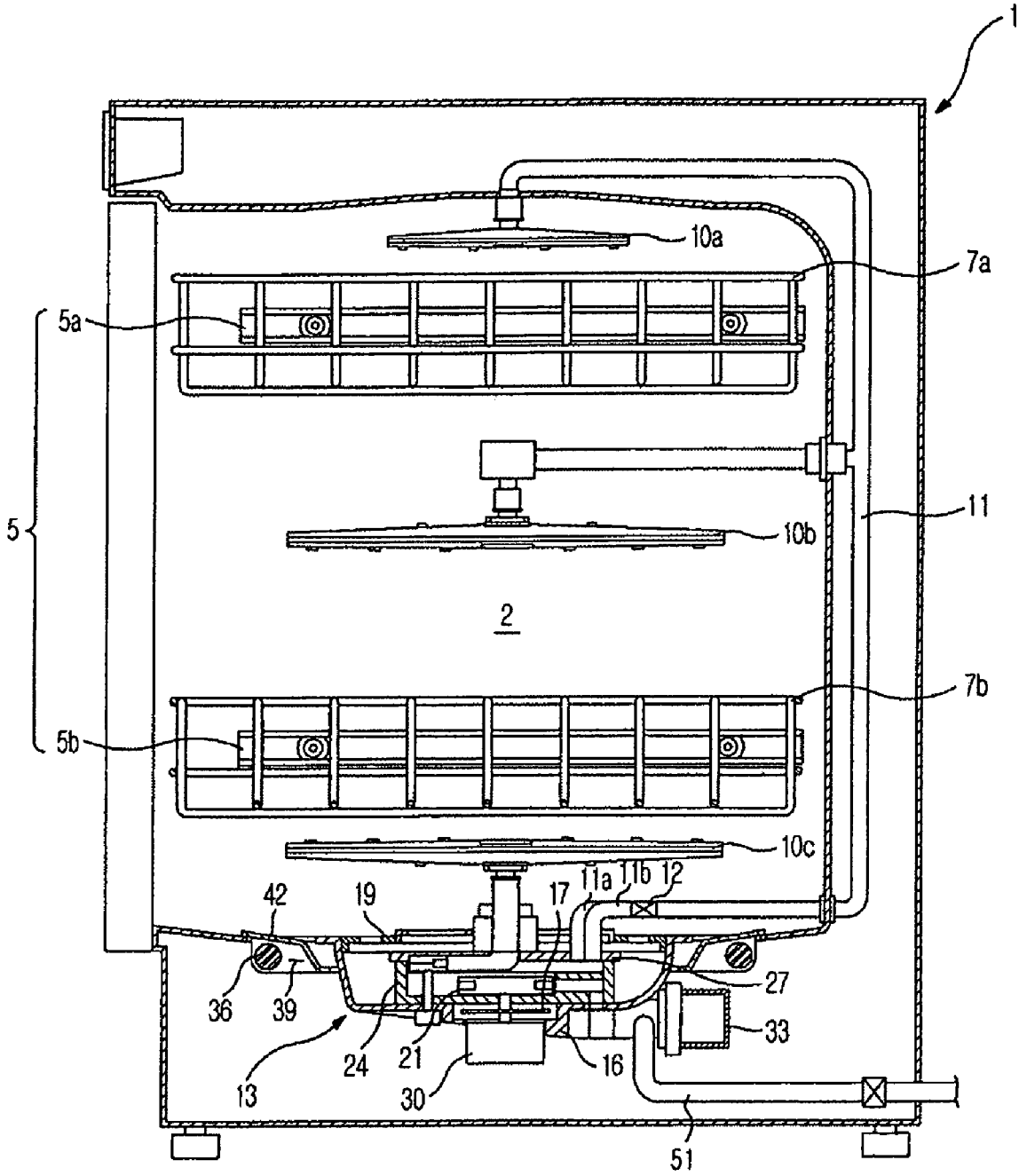
FIG. 1 is a side sectional view illustrating a dish washing machine according to the present embodiment.

Reference will now be made in detail to the embodiment, examples of which are illustrated in the accompanying drawings, wherein like reference numerals refer to like elements throughout. The embodiment is described below to explain the present invention by referring to the figures.

Referring to FIG. 1, the dish washing machine includes a machine body 1 forming the external appearance of the dish washing machine, a washing tub 2 disposed in the machine body 1, and a rack 5 fixed to a sidewall of the washing tub 2. The rack 5 includes an upper rack 5*a* and a lower rack 5*b*, by which dish baskets 7*a* and 7*b* are supported, respectively. Dishes may be placed in the dish baskets 7*a* and 7*b*.

At the washing tub 2 are mounted main nozzles 10*a* and 10*b* and a sub nozzle 10*c* to inject wash water. The wash water injected through the nozzles is directed toward the dish baskets 7*a* and 7*b*. The nozzles 10*a*, 10*b* and 10*c* are rotated by the injection pressure of the wash water injected through the nozzles 10*a*, 10*b* and 10*c*. The wash water injected through the nozzles 10*a*, 10*b*, and 10*c* collides with the dishes in the dish baskets 7*a* and 7*b* to wash the dishes.

At the bottom of the washing tub 2 is mounted a sump 13 to receive, pump, and supply wash water to the respective nozzles.

At a rear of the washing tub 2 is disposed a guide pipe 11 to supply wash water to the main nozzles 10*a* and 10*b*. The guide pipe 11 is connected to the sump 13. Consequently, the wash water flows to the main nozzles 10*a* and 10*b* through the guide pipe 11 due to strong pumping pressure of the sump 13.

The sub nozzle 10*c* is directly connected to the upper central part of the sump 13. Consequently, some of the wash water is injected through the sub nozzle 10*c* to wash dishes placed in the dish basket 7*b* adjacent to the sub nozzle 10*c*.

Meanwhile, a lower part of the guide pipe 11 includes an introduction guide pipe 11*a*, into which the wash water injected from the sump 13 is introduced, and a bypass pipe 11*b*. When filth, including food waste, accumulates in the sump 13 with the result that the pressure of the wash water is abnormally increased, the wash water is bypassed to the main nozzles 10*a* and 10*b* through the bypass pipe 11*b*.

In the bypass pipe 11*b* is mounted a check valve 12 to open the bypass pipe 11*b*, such that the wash water flows upward, only when the pressure of the wash water exceeds a predetermined pressure level.

The check valve 12 is well known to those skilled in the art, and therefore, a detailed description thereof will not be given.

Consequently, when the water pressure in the sump 13 is below the predetermined pressure level, the wash water is directed to the main nozzles 10*a* and 10*b* through the introduction guide pipe 11*a*. When the water pressure in the sump 13 is above the predetermined pressure level, on the other hand, the wash water is introduced into the bypass pipe 11*b* by an opening operation of the check valve, and is then directed to the main nozzles 10*a* and 10*b* together with the wash water introduced into the introduction guide pipe 11*a*.

The sump 13 includes a sump housing 16 forming an external appearance of the sump, a sump cover 19 to cover the sump housing 16, an impeller 21 disposed in the sump housing 16, an impeller casing 24 to which the impeller 21 is mounted, and an impeller casing cover 27 disposed on the impeller casing 24.

At a bottom of the sump housing 16 is mounted a pump motor 30 to drive the impeller 21.

To the pump motor 30 is coupled a rotary cutter-shaped pulverizer 17 to pulverize filth, including food waste, introduced into the sump 13. The pulverizer 17 is disposed between the sump housing 16 and the impeller casing 24.

At the side of the sump housing 16 are disposed a drainage pump 33 and a drainage pipe 51 to discharge wash water and filth in the sump 13 out of the dish washing machine.

At the edge of the sump 13 is mounted a heater 36 to heat wash water. At the bottom of the washing tub 2 is formed a heater receiving groove 39, which extends along the edge of the sump 13. The heater 36 is received in the heater receiving groove 39.

After the heater 36 is received in the heater receiving groove 39, the heater 36 is covered by a heater cover 42 to prevent the heater 36 from being exposed to the outside.

Figure 2:
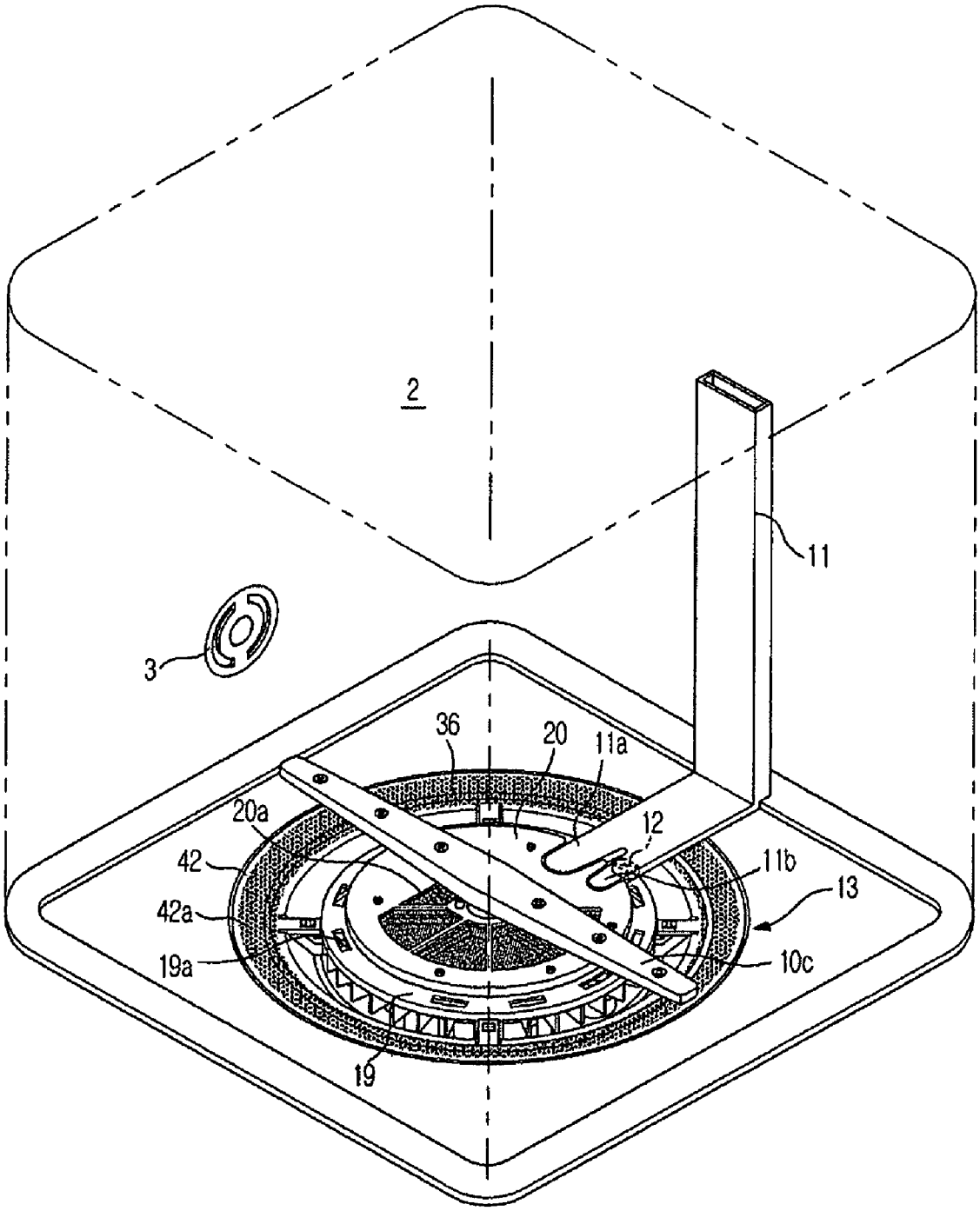
FIG. 2 is a perspective view illustrating the interior of the dish washing machine according to the present embodiment.

Referring to FIG. 2, an inlet port 3 is formed through one side of the washing tub 2 such that wash water can be introduced into the washing tub 2 through the inlet port 3. Wash water introduced through the inlet port 3 falls to the bottom of the washing tub 2 and is then introduced into the sump 13.

The sub nozzle 10*c* is rotatably coupled to the center of the sump 13. The guide pipe 11 is connected to the rear end of the sump 13 such that wash water is guided to the main nozzles 10*a* and 10*b* (see FIG. 1) through the guide pipe 11.

The sump cover 19 is mounted on the sump 13. Along an edge of the sump cover 19 are formed inlet holes 19*a*, which are arranged in regular intervals. Consequently, wash water is introduced into the sump 13 through the inlet holes 19*a*.

On the sump cover 19 is mounted a filter cover 20. To the filter cover 20 is mounted a mesh filter 20*a* to prevent filth collected in a filth chamber (not shown), which will be described below, from overflowing from the filth chamber and to allow only wash water to flow out of the filth chamber.

The heater 36 is mounted at an edge of the sump 13 in the shape of a ring. The heater cover 42 is mounted on the heater 36. In the heater cover 42 are formed a plurality of through-holes 42*a*, through which wash water flows to the heater 36. The wash water is heated by the heater 36, and is then introduced into the sump 13.

Meanwhile, the introduction guide pipe 11*a* and the bypass pipe 11*b* are coupled to the upper part of the sump 13, and the introduction guide pipe 11*a* and the bypass pipe 11*b* are arranged in parallel such that the introduction guide pipe 11*a* and the bypass pipe 11*b* are spaced a predetermined distance from each other.

Figure 3:
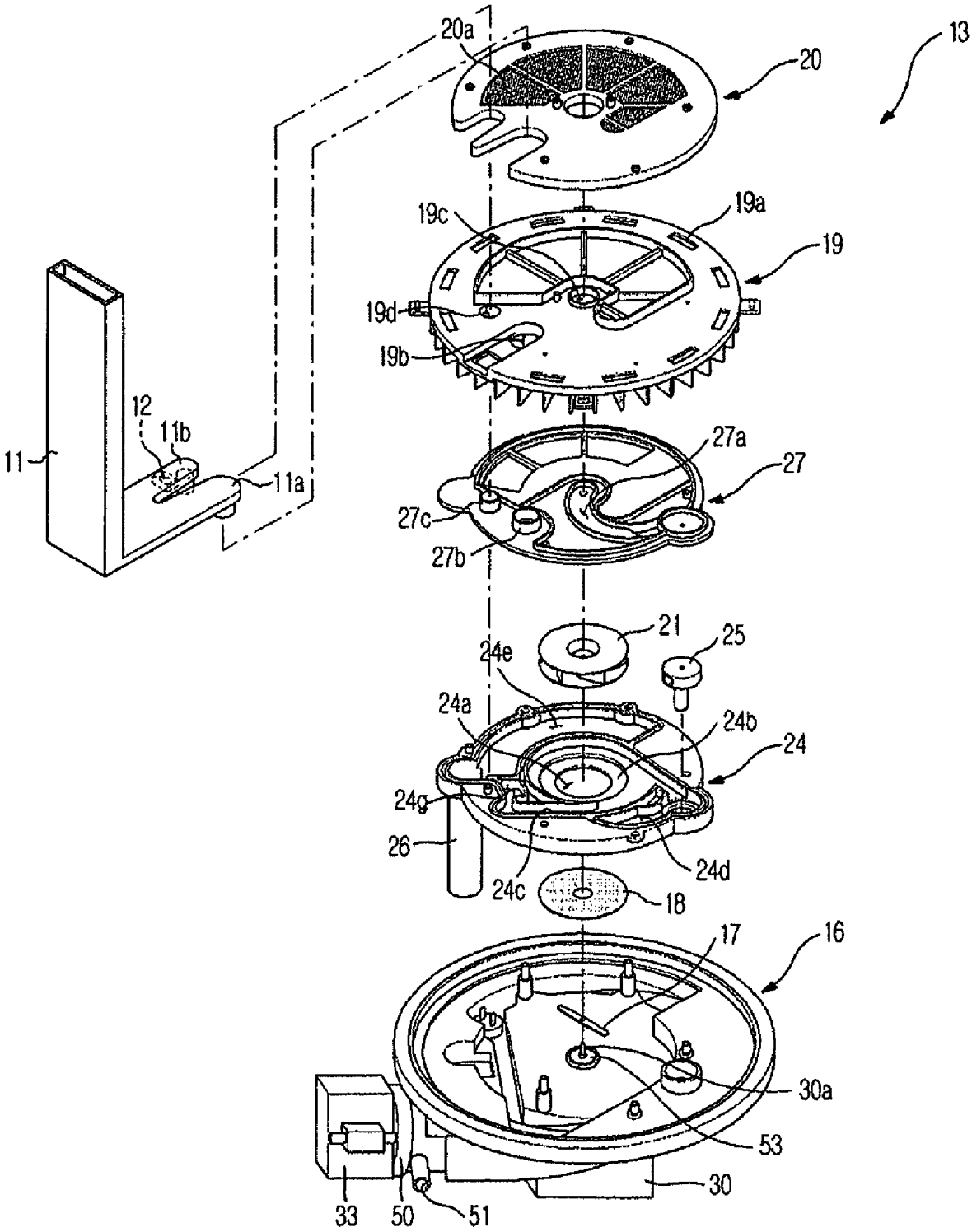
FIG. 3 is an exploded perspective view illustrating a sump and a guide pipe of the dish washing machine according to the present embodiment.

FIG. 3 illustrates the structure of the sump 13. At one side of the sump housing 16 is disposed a pump fixing part 50, to which the drainage pump 33 is fixed. To one side of the pump fixing part 50 is connected a drainage pipe 51 of the pump fixing part 50, through which wash water and filth are discharged.

The pump motor 30 is mounted at the bottom of the sump housing 16. A rotary shaft 30*a* of the pump motor 30 extends through the bottom of the sump housing 16.

At the center of the bottom of the sump housing 16 is disposed a sealing member 53, which surrounds the rotary shaft 30*a* to prevent wash water from leaking to the pump motor 30.

The impeller casing 24 is disposed on the sump housing 16. In the center of the impeller casing 24 is formed a communication hole 24*a*, which communicates with the sump housing 16. Around the communication hole 24*a* is disposed an impeller receiving part 24*b* to receive the impeller 21.

The pulverizer 17 is disposed at the bottom of the sump housing 16 while the pulverizer 17 is coupled to the rotary shaft 30*a*. On the pulverizer 17 is disposed a filth filter 18 to prevent relatively large-sized filth particles from being introduced into the impeller 21.

Preferably, the filth filter 18 is disposed below the communication hole 24*a*.

The impeller 21 is coupled to the rotary shaft 30*a* of the pump motor 30 such that the impeller 21 is rotated to pump wash water, including micro filth particles contained in the wash water, introduced into the sump housing 16 upward.

The impeller casing 24 is provided with a main channel 24*c* and a sub channel 24*d*, which diverge from the impeller receiving part 24*b*. The main channel 24*c* serves to guide wash water to the main nozzles 10*a* and 10*b* (see FIG. 1). The sub channel 24*d* serves to guide wash water to the sub nozzle 10*c* (see FIG. 1).

In the sub channel 24*d* is rotatably mounted a channel control valve 25, which is a two-way valve, to intermit the flow of wash water along the sub channel 24*d*. When the quantity of dishes to be washed is small, the sub channel 24*d* is closed by the channel control valve 25 such that wash water can flow only along the main channel 24*c*.

Wash water flowing along the main channel 24*c* is injected through the main nozzles 10*a* and 10*b* (see FIG. 1) to wash dishes. This is because the amount of wash water used is reduced when the quantity of dishes to be washed is small.

Beside the main channel 24*c* is formed a filth chamber 24*e*. The main channel 24*c* and the filth chamber 24*e* are connected with each other via a sampling channel 24*g*. Micro filth particles, which have been pulverized by the pulverizer 17, move into the main channel 24*c* through the filth filter 18 by the impeller 21, and are then collected in the filth chamber 24*e* together with wash water.

The end of the introduction guide pipe 11*a* of the guide pipe 11 is located in a terminal of the main channel 24*c*. The end of the bypass pipe 11*b* is located in the sampling channel 24*g*. Consequently, wash water introduced into the main channel 24*c* flows to the introduction guide pipe 11*a*. Wash water introduced into the sampling channel 24*g* and directed to the filth chamber 24*e* is introduced into the bypass pipe 11*b* only when the water pressure in the filth chamber exceeds a predetermined pressure level.

Adjacent to the inlet of the filth chamber 24*e* is mounted a drainage guide pipe 26, which is connected to the drainage pump 33. When the drainage pump 33 is operated, filth collected in the filth chamber 24*e* is discharged to the drainage pipe 51 along the drainage guide pipe 26. Consequently, the filth is automatically discharged out of the dish washing machine.

The end of the bypass pipe 11*b* is closer to the main channel 24*c* than to an inlet of the drainage guide pipe 26 about the main channel 24*c*. This is because, when filth excessively accumulates in the filth chamber 24*e* with the result that the water pressure in the filth chamber 24*e* is excessively increased, wash water flowing along the sampling channel 24*g* is introduced into the bypass pipe 11*b* before the wash water is introduced into the drainage guide pipe 26 with the result that the wash water affects the drainage pump 33.

The impeller casing cover 27 is disposed on the impeller casing 24. In the impeller casing cover 27 is formed a guide channel 27*a*, which communicates with the sub channel 24*d*. The guide channel 27*a* extends from an edge of the impeller casing cover 27 to a center of the impeller casing cover 27 in the shape of a curve.

The impeller casing 27 is provided at one side thereof with a first coupling part 27*b*, to which the introduction guide pipe 11*a* of the guide pipe 11 is coupled, and a second coupling part 27*c*, to which the bypass pipe 11*b* is coupled.

Consequently, when the sub channel 24*d* is opened by the channel control valve 25, wash water pumped by the impeller 21 passes through the channel control valve 25, and flows along the sub channel 24*d*. The wash water is guided to the sub nozzle 10*c* (see FIG. 1) along the guide channel 27*a*, which communicates with the sub channel 24*d*, and is then injected through the sub nozzle 10*c*.

The sump cover 19 is disposed on the impeller casing cover 27. In the center of the sump cover 19 is formed an engaging hole 19*c*, in which the lower end of the sub nozzle 10*c* (see FIG. 1) is engaged. The inlet holes 19*a*, through which wash water is introduced, are formed along the edge of the sump cover 19 such that the inlet holes 19*a* are arranged in regular intervals.

In the sump cover 19 are formed a first connection hole 19*b*, through which the introduction guide pipe 11*a* of the guide pipe 11 is inserted, and a second connection hole 19*d*, through which the bypass pipe 11*b* of the guide pipe 11 is inserted.

The filter cover 20 is disposed on the sump cover 19. The mesh filter 20*a* is mounted to the filter cover 20. The mesh filter 20*a* covers the top of the filth chamber 24*e* to prevent filth collected in the filth chamber 24*e* from passing through the mesh filter 20*a* together with wash water.

Specifically, when filth and wash water are introduced into the filth chamber 24*e*, the wash water passes through the mesh filter 20*a*. However, the filth is filtered by the mesh filter 20*a* and is left in the filth chamber 24*e*. When a predetermined amount of filth accumulates in the filth chamber 24*e*, the drainage pump 33 is operated, as previously described, to discharge the filth out of the dish washing machine.

The wash water separated from the filth is introduced into the sump 13 through the inlet holes 19*a*, and is then continuously circulated through the above-described course.

Hereinafter, the operation of the present embodiment will be described with reference to the accompanying drawings.

Figure 4:
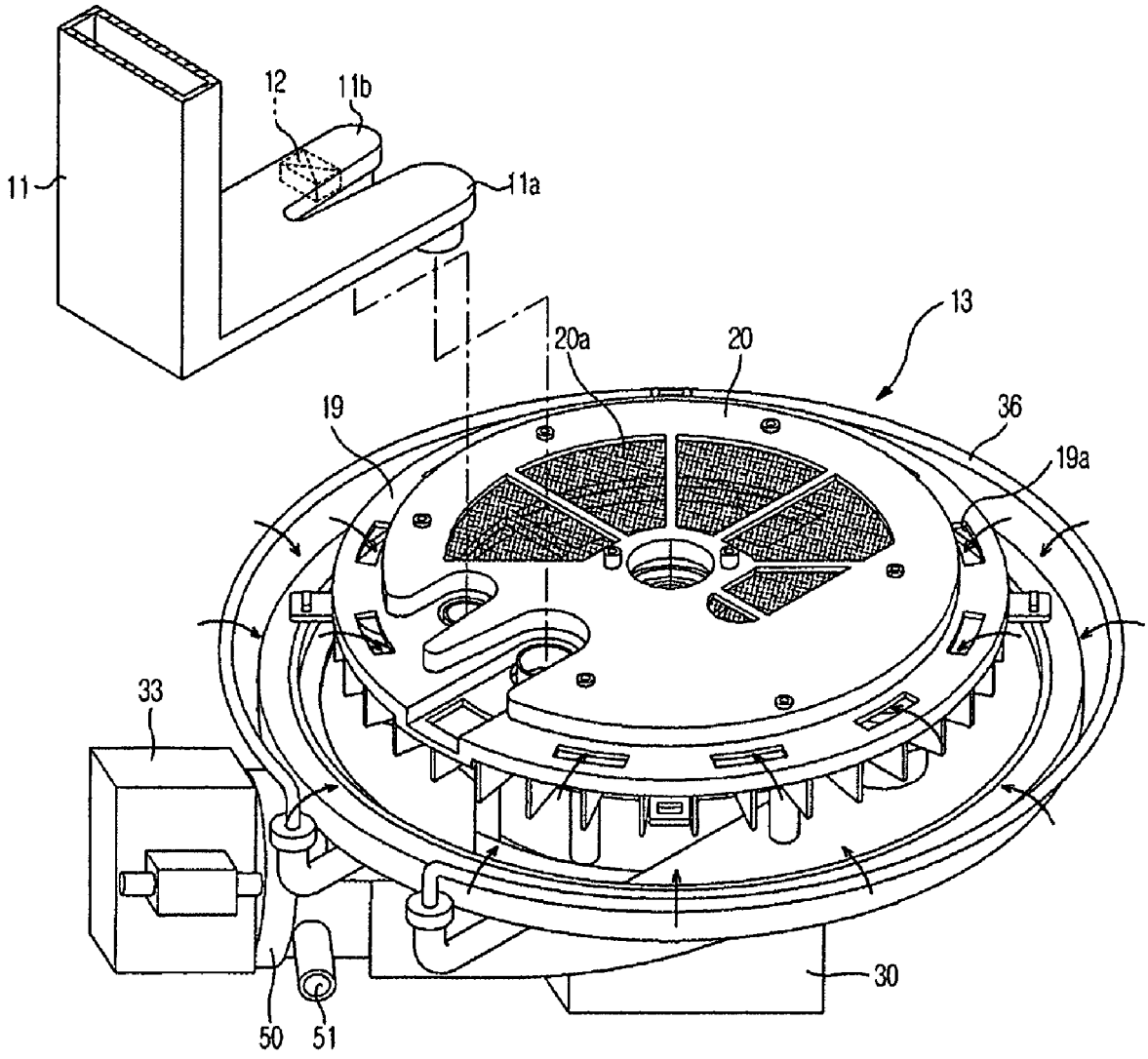
FIGS. 4 to 8 are perspective views sequentially illustrating the operation of the dish washing machine according to the present embodiment.

As shown in FIG. 4, wash water is heated by the heater 36, and is then introduced into the sump 13. As the dish washing operation is continuously performed, filth washed off dishes is also introduced into the sump 13.

Figure 5:
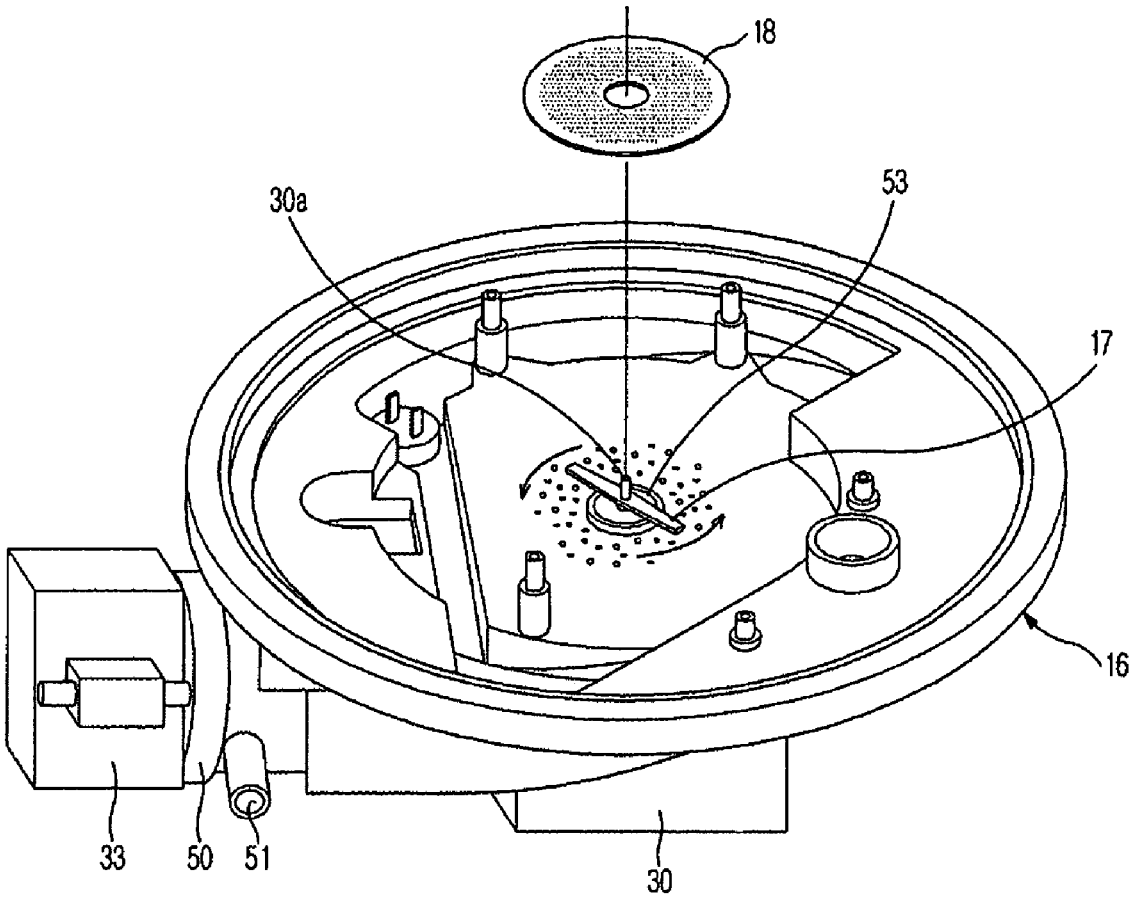

When the pump motor 30 is driven, as shown in FIG. 5, relatively large-sized filth particles are pulverized into small-sized filth particles by the rotary cutter-shaped pulverizer 17 coupled to the rotary shaft 30*a*. At this time, micro filth particles having a size small enough to pass through the filth filter 18 move upward together with the wash water by the suction operation of the impeller 21 (see FIG. 3).

However, filth particles having not passed through the filth filter 18 accumulate in the sump housing 16, and are discharged out of the dish washing machine along the drainage pipe 51 by the drainage operation of the drainage pump 33.

Figure 6:
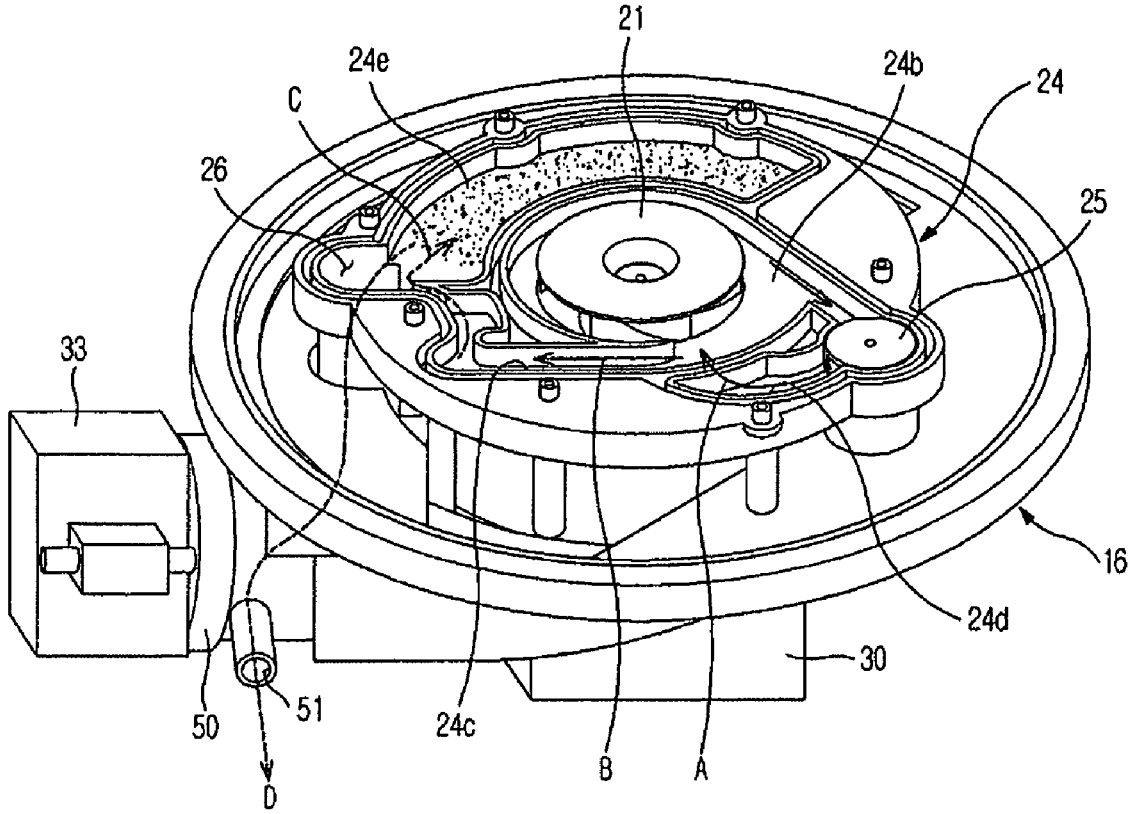

As shown in FIG. 6, the wash water and micro filth particles received in the sump housing 16 are pumped upward to the impeller casing 24 as the impeller 21 mounted to the rotary shaft is rotated.

The pumped wash water is moved from the impeller receiving part 24*b* to both the main channel 24*c* (in the direction indicated by arrow B) and the sub channel 24*d* (in the direction indicated by arrow A) due to the rotating force of the impeller. When the sub channel 24*d* is closed by the channel control valve 25, the wash water is moved only to the main channel 24*c*.

The wash water flowing along the main channel 24*c* in the direction indicated by arrow B is introduced into the introduction guide pipe 11*a* (see FIG. 2) due to the strong pressure of the impeller 21, is raised upward along the guide pipe 11, and then reaches the main nozzles 10*a* and 10*b* (see FIG. 1).

When the quantity of dishes to be washed is small, and therefore it is necessary to operate only the main nozzles 10*a* and 10*b* (see FIG. 1), the sub channel 24*d* is closed by the channel control valve 25. As a result, wash water flows along only the main channel 24*c*. The wash water flowing along the main channel 24*c* reaches the main nozzles 10*a* and 10*b* through the guide pipe 11, and is then injected through the main nozzles 10*a* and 10*b*.

When the quantity of dishes to be washed is large, and therefore it is necessary to operate the sub nozzle 10*c* (see FIG. 1) as well as the main nozzles 10*a* and 10*b*, the sub channel 24*d* is opened by the channel control valve 25. As a result, wash water flows in the direction indicated by arrow A. Subsequently, the wash water reaches the sub nozzle 10*c*, and is then injected through the sub nozzle 10*c*.

The filth chamber 24*e* is connected to the main channel 24*c*. Consequently, filth mixed with some wash water is moved (in the direction indicated by arrow C), and is then collected in the filth chamber 24*e*.

In the initial filth collection stage, an amount of filth collected in the filth chamber 24*e* is small, and therefore wash water introduced into the filth chamber 24*e* together with the filth immediately passes through the mesh filter 20*a* (see FIG. 3) with the result that the wash water pressure in the filth chamber 24*e* is not very high. Consequently, the bypass pipe 11*b* (see FIG. 3) remains closed by the check valve 12 (see FIG. 3), and therefore the wash water is not introduced into the bypass pipe 11*b*.

The drainage guide pipe 26, which is connected to the drainage pump 33, is disposed adjacent to the inlet of the filth chamber 24*e*. Consequently, the filth collected in the filth chamber 24*e* is discharged to the outside (in the direction indicated by arrow D) during the operation of the drainage pump 33.

Figure 7:
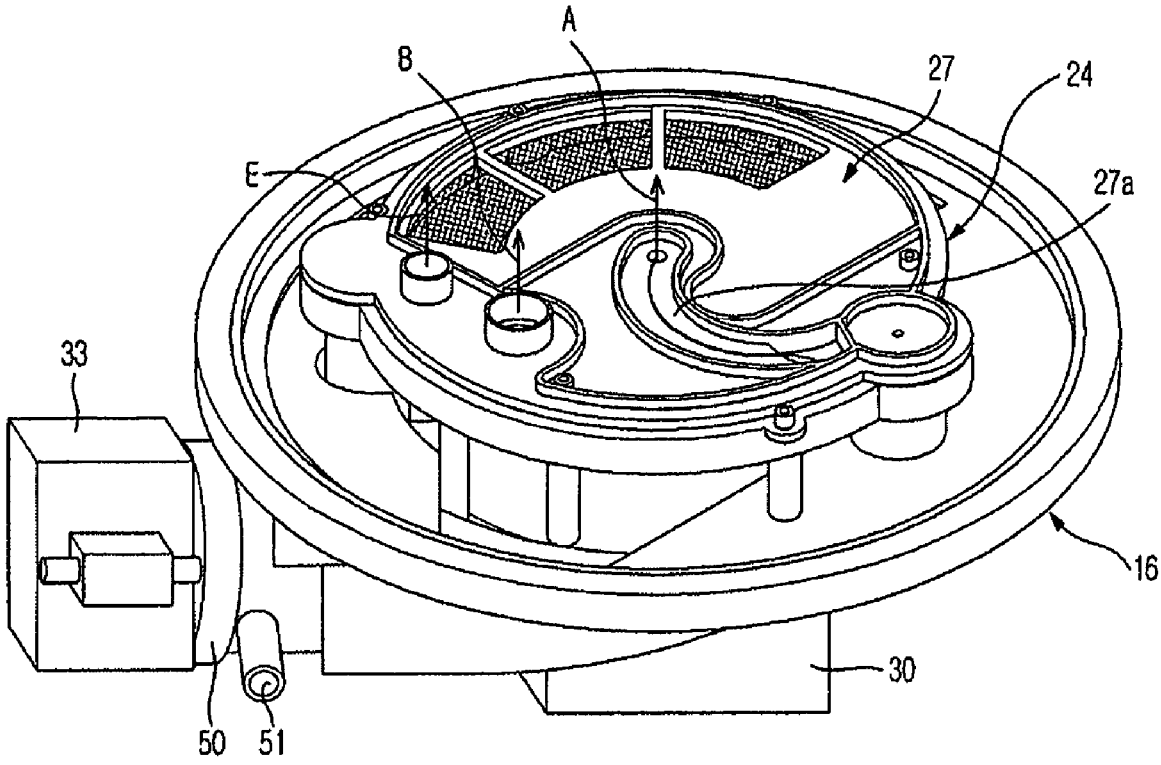

As shown in FIG. 7, the guide channel 27*a* is formed at the impeller casing cover 27 disposed on the impeller casing 24 such that the guide channel 27*a* communicates with the sub channel 24*d* (see FIG. 6).

When the impeller 21 (see FIG. 6) is operated while the sub channel 24*d* is opened by the channel control valve 25 (see FIG. 6), wash water also flows along the sub channel 24*d*, as previously described. The wash water flowing along the sub channel 24*d* is guided to the center of the impeller casing cover 27 along the guide channel 27*a*, is moved to the sub nozzle 10*c* (see FIG. 1) in the direction indicated by arrow A, and is injected through the sub nozzle 10*c*.

Arrow B indicates the flow direction of the wash water flowing to the main nozzles 10*a* and 10*b* (see FIG. 1).

As filth accumulates in the filth chamber 24*e* (see FIG. 3) with the result that the mesh filter 20*a* (see FIG. 3) is considerably clogged by the filth, wash water does not pass through the mesh filter, and therefore the water pressure in the filth chamber 24*e* is increased. When the water pressure exceeds a predetermined pressure level, the wash water is directed to the bypass pipe 11*b* (see FIG. 3) in the direction indicated by arrow E. At this time, the check valve 12 (see FIG. 3) is opened, and therefore the wash water is introduced into the bypass pipe 11*a* (see FIG. 3).

Figure 8:
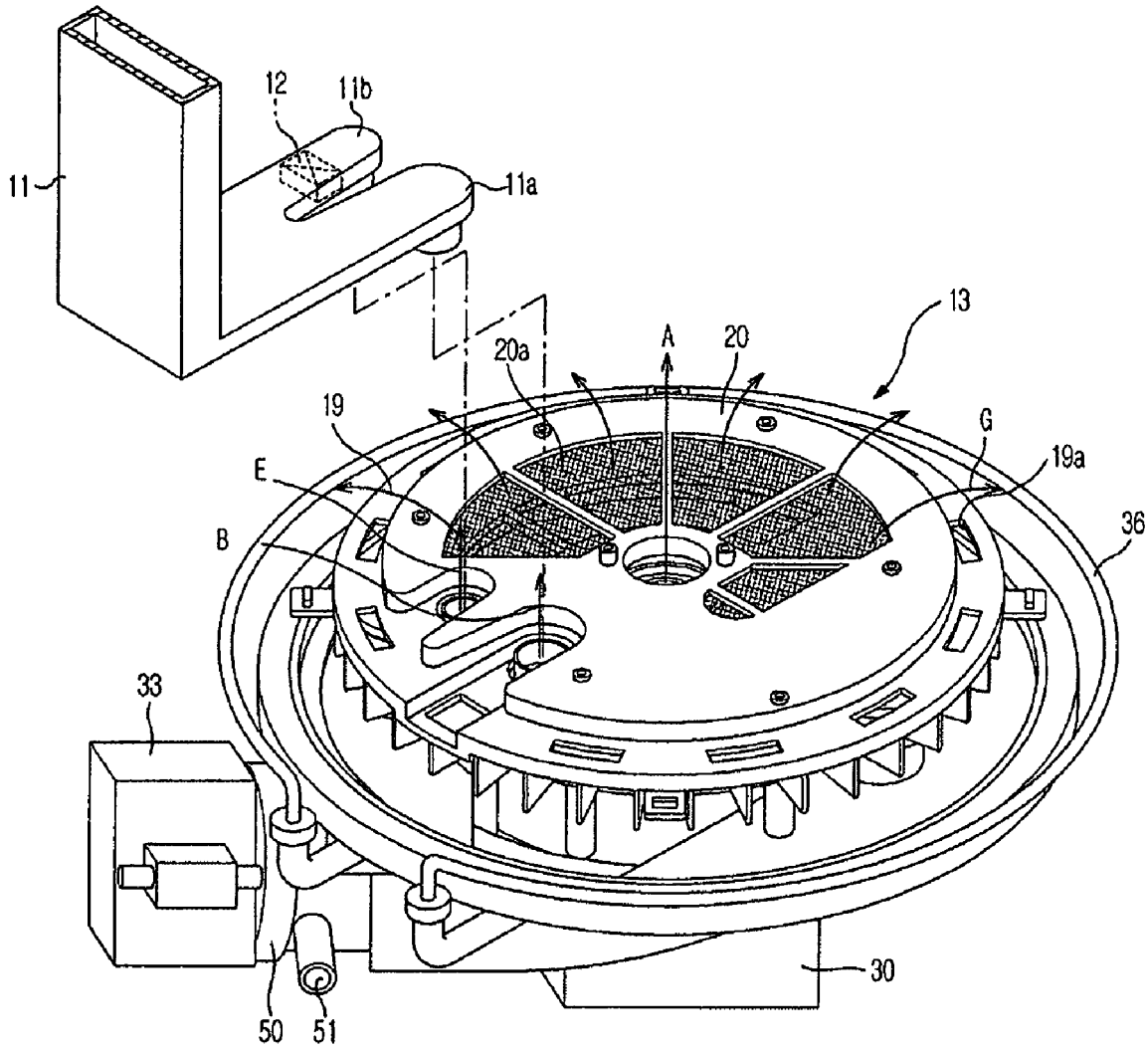

When a considerable amount of filth accumulates in the filth chamber 24*e* (see FIG. 3), as shown in FIG. 8, some of the wash water introduced into the filth chamber 24*e* passes through the mesh filter 20*a*, and is discharged in the direction indicated by arrow G.

Wash water newly introduced into the filth chamber 24*e* and the existing wash water in the filth chamber 24*e* are raised in the direction indicated by arrow E, as previously described, when the check valve 11*a* is opened. The wash water flowing in the direction indicated by arrow E is mixed with wash water flowing in the direction indicated by arrow B. The mixed wash water flows to the main nozzles 10*a* and 10*b* (see FIG. 1), and is injected through the main nozzles 10*a* and 10*b*.

As apparent from the above description, the present embodiment has the effect of bypassing wash water introduced into the filth chamber when filth, including food waste, excessively accumulates in the filth chamber with the result that the wash water pressure in the filth chamber is increased, thereby preventing the unintentional drainage of the wash water.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A dish washing machine, comprising:

a washing tub;

at least one injection nozzle disposed in the washing tub;

a sump disposed in the washing tub to forward wash water to the at least one injection nozzle and including a filth chamber disposed in the sump;

a guide pipe connected between the sump and the at least one injection nozzle; and a bypass pipe, diverging from a portion of the guide pipe, connected to the sump to bypass the wash water in the sump to the guide pipe when pressure of the wash water in the filth chamber exceeds a predetermined pressure level, wherein the sump includes a sump housing forming a lower part of the sump, an impeller casing disposed on the sump housing to receive a washing impeller to pump wash water, the impeller casing being provided with a main channel and a sub channel to guide the flow of the wash water pumped by the washing impeller, a filth chamber communicating with the main channel to collect filth contained in the wash water, and a sampling channel to allow the filth chamber and the main channel to communicate with each other therethrough, and an impeller casing cover to cover the impeller casing, and wherein an end of the bypass pipe is coupled to the impeller casing cover while the end of the bypass pipe is located at an upper part of an outlet of the sampling channel.

2. The dish washing machine according to claim 1, wherein the bypass pipe is opened to bypass the introduced wash water to the guide pipe when the pressure of the wash water introduced into the bypass pipe exceeds the predetermined pressure level.

3. The dish washing machine according to claim 2, further comprising:

a check valve disposed in the bypass pipe to open and close the bypass pipe based on the pressure of the wash water introduced into the bypass pipe.

4. The dish washing machine according to claim 1, wherein the bypass pipe communicates with the filth chamber.

5. The dish washing machine according to claim 4, further comprising:

a mesh filter disposed on the filth chamber to separate the filth from the wash water introduced into the filth chamber, wherein the bypass pipe is coupled to one side of the mesh filter.

6. The dish washing machine according to claim 4, wherein the at least one injection nozzle includes a main nozzle to continuously inject wash water during the washing operation of the dish washing machine and a sub nozzle to selectively inject wash water during the washing operation of the dish washing machine, and wherein the dish washing machine further comprises:

a main channel disposed in the sump such that the main channel communicates with the main nozzle;

a sub channel disposed in the sump such that the sub channel communicates with the sub nozzle; and a sampling channel disposed in the sump and allowing the main channel and the filth chamber to communicate with each other therethrough, and wherein the bypass pipe is located above the sampling channel such that the bypass pipe communicates with the sampling channel.

7. The dish washing machine according to claim 6, further comprising:

a drainage pump disposed at the sump to drain the wash water and filth in the sump out of the dish washing machine; and a drainage guide pipe to allow the drainage pump and the filth chamber to communicate with each other therethrough, wherein an end of the bypass pipe is disposed at one side of the drainage guide pipe such that the end of the bypass pipe is closer to the main channel than to the drainage guide pipe.

8. The dish washing machine according to claim 1, wherein the guide pipe is provided at a lower end thereof with the bypass pipe and an introduction guide pipe arranged in parallel with the bypass pipe, the introduction guide pipe being spaced apart from the bypass pipe and communicating with the main channel to guide wash water to the guide pipe, whereby wash water passing through the bypass pipe is mixed with the wash water passing through the introduction guide pipe, and the mixture is moved to the injection nozzle.

9. A dish washing machine, comprising:

a washing tub;

at least one injection nozzle rotatably disposed in the washing tub to inject wash water;

a sump to pump wash water to the at least one injection nozzle;

a guide pipe connected between the sump and the at least one injection nozzle to guide the wash water to the at least one injection nozzle;

an introduction guide pipe disposed at an end of the guide pipe and coupled to the sump to transfer the wash water from the sump to the guide pipe;

a bypass pipe connected to the end of the guide pipe and coupled to the sump to bypass wash water to the guide pipe when pressure of the wash water in the sump exceeds a predetermined pressure level;

a main channel disposed in the sump such that the main channel communicates with the introduction guide pipe to guide the pump wash water to the introduction guide pipe;

a filth chamber disposed in the sump communicating with the main channel to collect filth contained in the wash water; and a sampling channel disposed in the sump and allowing the main channel and the filth chamber to communicate with each other therethrough, wherein the bypass pipe is located at an upper part of an outlet of the sampling channel, and the filth chamber communicates with the sampling channel.

10. The dish washing machine according to claim 9, further comprising:

a check valve disposed in the bypass pipe such that the check valve is opened and closed based on the pressure of the wash water.

11. The dish washing machine according to claim 9, further comprising:

a drainage guide pipe disposed at the sump such that the drainage guide pipe communicates with the filth chamber to guide the drainage of the wash water and filth, wherein an end of the bypass pipe is disposed closer to an outlet of the sampling channel than to an inlet of the drainage guide pipe.

* * * * *

UNITED STATES PATENT AND TRADEMARK OFFICE

CERTIFICATE OF CORRECTION

PATENT NO. : 7,963,292 B2
APPLICATION NO. : 12/076124
DATED : June 21, 2011
INVENTOR(S) : Kennichi et al.

It is certified that error appears in the above-identified patent and that said Letters Patent is hereby corrected as shown below:

Title Page, Item (75) Column 1 (Inventors), Line 3, Delete "Seongman-si" and insert -- Seongnam-si --, therefor.

Title Page, Item (75) Column 1 (Inventors), Line 4, Delete "Suweon-si (KR)" and insert -- Suwon-si (KR) --, therefor.

Signed and Sealed this
Fifth Day of June, 2012

David J. Kappos

David J. Kappos
*Director of the United States Patent and Trademark Office*